US005749795A

United States Patent [19]

Schmidt et al.

[11] Patent Number: 5,749,795

[45] Date of Patent: *May 12, 1998

[54] IRON GOLF CLUB HEAD WITH DUAL INTERSECTING RECESSES

[75] Inventors: Glenn H. Schmidt, Malibu; Richard C. Helmstetter, Carlsbad, both of Calif.

[73] Assignee: Callaway Golf Company, Carlsbad, Calif.

[ * ] Notice: The term of this patent shall not extend beyond the expiration date of Pat. No. 5,472,203.

[21] Appl. No.: 543,647

[22] Filed: Oct. 16, 1995

Related U.S. Application Data

[63] Continuation of Ser. No. 235,930, May 2, 1994, Pat. No. 5,472,203, which is a continuation-in-part of Ser. No. 52,697, Apr. 30, 1993, Pat. No. 5,330,187, which is a continuation-in-part of Ser. No. 921,857, Aug. 5, 1992, Pat. No. 5,282,625.

[51] Int. Cl.[6] ..... A63B 53/04

[52] U.S. Cl. ..... 473/350; 473/329

[58] Field of Search ..... 473/324, 327, 473/328, 329, 330, 331, 332, 334, 335, 336, 338, 339, 341, 342, 345, 346, 347, 348, 349, 350

[56] References Cited

U.S. PATENT DOCUMENTS

| | | |
|---|---|---|
| D. 196,734 | 10/1963 | Solheim . |
| D. 228,355 | 9/1973 | Penna . |
| D. 234,209 | 1/1975 | Bizovi . |
| D. 234,963 | 4/1975 | Hirata . |
| D. 247,383 | 2/1978 | Adkins . |
| D. 248,181 | 6/1978 | Cervantes . |
| D. 321,920 | 11/1991 | Parente et al. . |
| 1,485,685 | 3/1924 | McMahon . |
| 1,517,476 | 12/1924 | Tyler . |
| 1,854,548 | 4/1932 | Hunt . |
| 1,894,706 | 1/1933 | Reach . |

(List continued on next page.)

FOREIGN PATENT DOCUMENTS

| | | |
|---|---|---|
| 901416 | 4/1985 | Belgium . |
| 582366 | of 1994 | European Pat. Off. . |
| 608128 | 1/1994 | European Pat. Off. . |
| 2575393 | 7/1986 | France . |
| 62-233176 | 10/1987 | Japan . |
| 63-19168 | 1/1988 | Japan . |
| 63-267376 | 11/1988 | Japan . |
| 268078 | 3/1990 | Japan . |

(List continued on next page.)

OTHER PUBLICATIONS

"Reflex", Golf Digest, Feb. 1978, p. 22.

"Some of Our Best Friends are Hookers and Pushers", Golf World, Jan. 1974, p. 45.

"The Ounce That Counts", Golf World, Jan. 24, 1975, pp. 46 & 47.

"Stroke-Savers", Golf Digest, March 1988, pp. 82–83.

"The Wilson Staff Dynapower Iron", Time, Mar. 24, 1967, p. 1.

*Primary Examiner*—Steven B. Wong

*Attorney, Agent, or Firm*—William W. Haefliger

[57] ABSTRACT

A golf club head having a body defining a heel, toe, top wall, bottom wall, and a front wall defining an upwardly and rearwardly inclined front face and rear face, comprising a body defining a forwardly extending main recess located rearwardly of the front wall; the body also defining an undercut recess located rearwardly of the front wall rear face and extending outwardly from the main recess toward the top wall and toward the bottom wall, proximate the rear face; the head having rearward projection with downward thickening between the top wall and the main recess, and rearwardly of the undercut recess that extends toward the top wall, the undercut recess that extends toward the top wall having forward and rearward sides that extend generally parallel to one another; the rearward projection having a lower surface facing the main recess, the lower surface intersecting the rearward side of the undercut recess at an acute angle.

85 Claims, 13 Drawing Sheets

U.S. PATENT DOCUMENTS

| | | |
|---|---|---|
| 1,894,707 | 1/1933 | Reach . |
| 1,906,239 | 5/1933 | Reach . |
| 1,946,007 | 2/1934 | Watson . |
| 1,953,604 | 4/1934 | Heller . |
| 1,980,408 | 11/1934 | Janksy . |
| 1,993,928 | 3/1935 | Glover . |
| 2,129,068 | 9/1938 | Reach . |
| 2,231,847 | 2/1941 | Dickson et al. . |
| 2,781,197 | 2/1957 | Wiley . |
| 3,043,596 | 7/1962 | Ehmke . |
| 3,068,011 | 12/1962 | Sano . |
| 3,079,157 | 2/1963 | Turner . |
| 3,134,596 | 5/1964 | Boznos . |
| 3,199,872 | 8/1965 | Taylor . |
| 3,680,868 | 8/1972 | Jacob . |
| 3,841,641 | 10/1974 | Bennett . |
| 3,847,399 | 11/1974 | Raymont . |
| 3,880,430 | 4/1975 | McCabel . |
| 3,923,308 | 12/1975 | Mills . |
| 3,967,826 | 7/1976 | Judice . |
| 4,000,902 | 1/1977 | Perkins . |
| 4,043,562 | 8/1977 | Shillington . |
| 4,113,249 | 9/1978 | Beery . |
| 4,121,832 | 10/1978 | Ebbing . |
| 4,128,244 | 12/1978 | Duclos . |
| 4,199,144 | 4/1980 | Skelly . |
| 4,252,262 | 2/1981 | Igarashi . |
| 4,272,572 | 6/1981 | Netherly . |
| 4,398,965 | 8/1983 | Campau . |
| 4,405,149 | 9/1983 | Piegay . |
| 4,438,946 | 3/1984 | Piegay . |
| 4,447,493 | 5/1984 | Driscoll et al. . |
| 4,484,746 | 11/1984 | Brill . |
| 4,573,685 | 3/1986 | Young, IV et al. . |
| 4,632,400 | 12/1986 | Boone . |
| 4,653,756 | 3/1987 | Sato . |
| 4,660,832 | 4/1987 | Shomo . |
| 4,715,601 | 12/1987 | Lamanna . |
| 4,736,949 | 4/1988 | Muroi . |
| 4,740,345 | 4/1988 | Nagasaki et al. . |
| 4,746,124 | 5/1988 | Comitz . |
| 4,792,139 | 12/1988 | Nagasaki et al. . |
| 4,798,383 | 1/1989 | Nagasaki et al. . |
| 4,848,747 | 7/1989 | Fujimura et al. . |
| 4,854,581 | 8/1989 | Long . |
| 4,865,345 | 9/1989 | Piegay . |
| 4,869,507 | 9/1989 | Sahm . |
| 4,884,812 | 12/1989 | Nagasaki et al. . |
| 4,913,435 | 4/1990 | Kobayashi . |
| 4,921,253 | 5/1990 | Tesori . |
| 4,928,972 | 5/1990 | Nakanishi et al. . |
| 4,957,294 | 9/1990 | Long . |
| 4,960,279 | 10/1990 | Harris, Jr. . |
| 4,964,640 | 10/1990 | Nakanishi et al. . |
| 4,986,541 | 1/1991 | Teramoto et al. . |
| 4,995,609 | 2/1991 | Parente et al. . |
| 4,995,630 | 2/1991 | Piegay . |
| 5,016,882 | 5/1991 | Fujimura et al. . |
| 5,026,056 | 6/1991 | McNally et al. . |
| 5,046,733 | 9/1991 | Antonious . |
| 5,067,711 | 11/1991 | Parente et al. . |
| 5,078,398 | 1/1992 | Reed et al. . |
| 5,082,279 | 1/1992 | Hull et al. . |
| 5,104,457 | 4/1992 | Viljoen et al. . |
| 5,118,562 | 6/1992 | Johnson et al. . |
| 5,127,653 | 7/1992 | Nelson . |
| 5,176,384 | 1/1993 | Sata et al. . |
| 5,277,423 | 1/1994 | Artus . |
| 5,282,625 | 2/1994 | Schmidt et al. . |
| 5,301,946 | 4/1994 | Schmidt et al. . |
| 5,312,105 | 5/1994 | Cleveland . |
| 5,330,187 | 7/1994 | Schmidt et al. . |
| 5,437,456 | 8/1995 | Schmidt et al. ..... 473/350 |
| 5,472,203 | 12/1995 | Schmidt et al. ..... 473/350 |

FOREIGN PATENT DOCUMENTS

| | | |
|---|---|---|
| 371974 | 5/1932 | United Kingdom . |
| 1534471 | of 1977 | United Kingdom . |
| 2165461 | 4/1986 | United Kingdom . |

IRON GOLF CLUB HEAD WITH DUAL INTERSECTING RECESSES

BACKGROUND OF THE INVENTION

This application is a continuation of Ser. No. 08/235,930, filed May 2, 1994, now U.S. Pat. No. 5,472,203, which is a continuation-in-part of Ser. No. 08/052,697, filed Apr. 30, 1993, now U.S. Pat. No. 5,330,187 which is a continuation-in-part of Ser. No. 08/921,857, filed Aug. 5, 1992, now U.S. Pat. No. 5,282,625.

This invention relates generally to golf clubs, and more particularly to golf club irons of improved construction, to achieve advantages, such as twist resistance, during impact with golf balls, and delayed momentum transfer to golf balls during stroking. In this regard, and in the past, irons evolved in design from flat back to hollow back structure, the present invention providing a further evolution in back structure to achieve virtual head enlargement effects.

Many efforts have been made to design iron heads to achieve higher energy availability for transfer to the golf ball, when the ball is impacted by the head. However, no way was known, to our knowledge, to achieve delayed momentum transfer to the ball, over the very short time interval when the ball remains in contact with the head face, in the novel and unusual manner as achieved by the present invention; and no way was known to couple such delayed energy transfer with head twist resistance, in the manner to be described.

SUMMARY OF THE INVENTION

It is a major object of the invention to provide an improved iron head construction meeting the need for a delayed momentum transfer effect to the ball during club stroking, and also to provide club head increased twist resistance. Basically, the invention, as embodied in a head metallic body, is constructed to define two intersecting recesses rearwardly of the head front wall, and bounded by head metallic extents projecting rearwardly proximate peripheral regions of the head face defining front wall. For example, the head may include:

a) a body defining a forwardly extending main recess located rearwardly of the front wall, b) and the body also defining an undercut recess located directly rearwardly of the front wall and extending outwardly from the main recess toward at least two of the following:

i) the top wall ii) the bottom wall iii) the toe iv) the heel.

As will be seen, the undercut recess may extend outwardly from its intersection with the main recess toward all of the top and bottom walls, and the toe and heel, whereby the undercut recess may then bound the main recess. This construction facilitates slightly delayed forward transfer of momentum of the body metal rearwardly of the undercut recess, to the front wall and front face, via peripheral extents of the head. Typically, the metal of the head has reduced thickness directly rearwardly of the front wall periphery, due to the provision of the undercut recess, as referred to. This also enables reallocation of some metal to project rearwardly from the looping recess, enhancing head peripheral weighting for anti-twist effect.

Another object is to extend undercut recess upwardly and downwardly into proximity with the uppermost and lowermost extents of the head front face, and to redistribute head metal to project rearwardly of the undercuts, whereby a significant sweet spot enlarging effect is achieved. Lateral sweet spot enlargement is also provided by undercuts at the toe and heel.

Another objective is to provide an undercut recess, as referred to, which extends in a loop that lies generally parallel to the inclined front face of the iron. The inclination of that loop varies with the number of the iron, designating different front face inclinations, as for example 1 to 9 irons and wedges.

A further object is to provide the head with a rearward projection with upward thickening between the bottom wall and the main recess, and rearwardly of the undercut recess that extends toward the bottom wall; and the head may also have a rearward projection with downward thickening between the top wall and the main recess, and rearwardly of the undercut recess that extends toward the top wall.

An additional object is to provide upward thickening of the lower rearward projection, as referred to, which substantially exceeds said downward thickening of the upper rearward projection, as referred to; and typically, the upward thickening of the lower rearward projection is at least twice the downward thickening of the upper rearward projection, as will be seen.

Further, the undercut recess that extends toward the top wall of the head typically has forward and rearward sides that extend generally parallel to one another. The upper rearward projection, as referred to, has a lower surface facing the main recess, that lower surface intersecting the rearward side of the undercut recess at an acute angle; and the undercut recess that extends toward the bottom wall of the head typically has forward and rearward sides that extend in generally parallel relation. The lower rearward projection, as referred to, has an upper surface facing the main recess, that upper surface intersecting the rearward side of the undercut recess that extends toward the bottom wall at an obtuse angle. These relationships also contribute to the novel structures, mode of operation and results of the invention.

A yet further object is to provide an undercut recess extending toward the top wall to have slant height $S_1$ above the main recess, and an undercut recess extending toward the bottom wall to have slant height $S_2$ below the main recess, wherein $S_2$ substantially exceeds $S_1$. Typically, $S_2/S_1$ exceeds 1.5. Further, the head typically defines a first web that is upwardly concave toward the undercut recess that extends toward the bottom wall, and a second web that is downwardly concave toward the undercut recess that extends toward the top wall. Also, the second web typically has minimum thickness $t_1$ between the top wall and the undercut recess. The front wall has thickness $t_2$, and wherein $t_1=t_2$; also, the front web typically has minimum thickness $t_3$ between the bottom wall and the undercut recess, and $t_3=t_2$.

As will be seen, the head, by virtue of such webs, has C-shaped cross section in a plane normal to head length dimension between the toe and heel of the head. These relationships also contribute to the novel structure, mode of operation, and results of the invention.

A further object is to provide webs at various locations and of various configurations at upper and/or lower regions of iron heads, as will appear.

Yet another object is to provide a set of irons, each iron incorporating the dual intersecting recesses, as referred to, and the rearward projections extending generally horizontally irrespectively of the angles of the front faces of the irons in the set.

These and other objects and advantages of the invention, as well as the details of illustrative embodiments, will be more fully understood from the following specification and drawings, in which:

DRAWING DESCRIPTION

DETAILED DESCRIPTION

Figure 1:
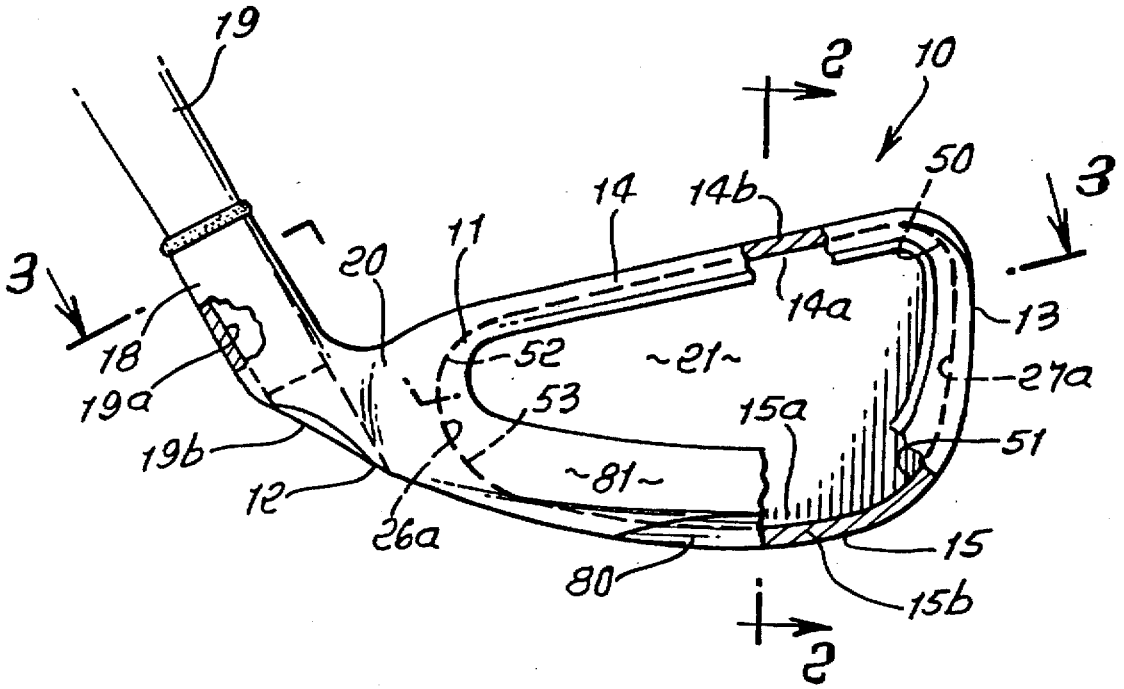
FIG. 1 is a rear elevation of a #1 iron of a golf club set incorporating the invention.

Referring first to FIG. 1, the illustrated golf club head 10, in the form of a #1 iron of a set, has a body 11 defining a heel 12, toe 13, top wall 14, and bottom wall or sole 15. The body also defines an upwardly and rearwardly inclined front face 16 at the frontal side of an associated front wall 17. A hosel is shown at 18 and integrally joins the body via neck 20; and a shaft 19 extends into a bore 19*a* that extends through the hosel, as seen at bottom bore opening 19*b* and is anchored therein in a suitable manner. Opening 19*b* may be suitably plugged. The head and hosel may consist of a one-piece, metallic steel casting, other metals and alloys being usable.

In accordance with the invention, the body defines two intersecting recesses related to rearwardly elongated body projections, typically extending rearwardly, as will be described, irrespective of the head front face angularity. The two recesses include a forwardly and rearwardly extending main recess 21, and an undercut recess 22 located directly rearwardly of the front wall and extending laterally outwardly from the forwardmost extent of the main recess 21, toward at least two of the following:

i) top wall 14 ii) bottom wall or sole 15 iii) the toe region 13 iv) the heel region 12.

Figure 2:
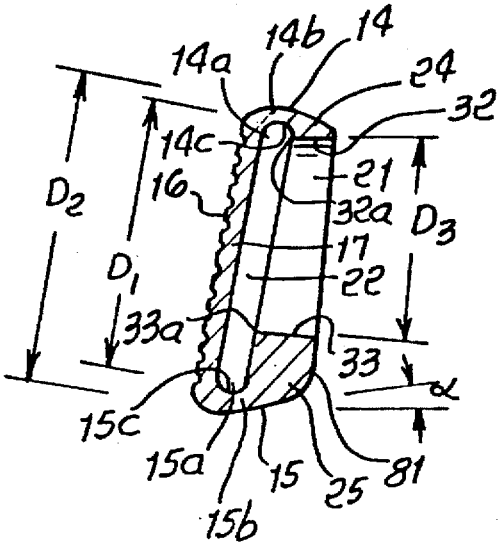
FIG. 2 is a section taken on lines 2—2 of FIG. 1.

Typically, the undercut recess portions 14*a* and 15*a*, associated with walls 14 and 15, are elongated directionally between the toe and heel, over the major length of the head, thereby achieving a large portion of the benefits of the invention. These benefits include metal redistribution toward the upper and lower peripheries of the head, and projecting rearwardly at 24 and 25, for enhancing anti-twist of the head during stroking and ball impact. Such metal rearward redistribution, i.e., lengthening in a rearward direction, as at 24 and 25, rearwardly of undercuts 14*a* and 15*a*, is believed to achieve somewhat delayed momentum transfer from the metal portions 24 and 25, to the front wall and front face 16, thereby maintaining a greater time interval of front face contact with the ball during stroking, for better ball control. The size and mass of the lower projection 25 substantially exceeds the size and mass of the upper projection 24, as is seen in FIG. 2, enhancing the delay effect.

Note that such momentum transfer, visualized in the form of forward waves, is required to pass around and through the reduced thickness forward portions 14*b* and 15*b* of the rearwardly projecting portions 24 and 25, enhancing such delay. Such delay of wave travel through narrowed regions (or webs or bridges or ribs) 14*b* and 15*b* are facilitated by the outwardly concave curvature at 14*c* and 15*c*, or other similar thickness narrowing shape, bounding the outermost extents of the undercuts 14*a* and 15*a*. Enhanced performance and ball control have been determined by repeated, actual use of such an iron, both with humans and robots. A sweet spot enlarging effect (vertically) is achieved without requiring head vertical enlargement. Note that the undercuts 14*a* and 15*a* are near the uppermost and lowermost extents of face 16, and the slant height dimension $D_1$ of the undercut recess is 90% to 95% of the slant height $D_2$ of face 16. Thus, $$0.90<D_1/D_2<0.95.$$

The undercut recess portions 12*a* and 13*a*, associated with the heel and toe, and associated metal redistribution rearwardly and functionally outwardly (i.e., enlarging effect) from those undercuts, contributes to and adds to the same effects as described above for the undercut recess portions 14*a* and 15*a*, i.e., the sweet spot is enlarged toward the toe and heel. The undercut recess projects outwardly at 12*a*, 14*a*, and 15*a* at the heel, toe and toward the top walls, respectively, i.e., from the edges 34*a*, 35*a*, and 32*a*, to an extent $w_1$ (which may vary, as shown); however, the front-to-rear thickness $t_1$ of the undercut recess is approximately as follows:

$$0.5t_1<w_1<1.5t_1$$

Note that the undercut recess at 15*a* projects downwardly from edge 33*a* to an extent between 1.5 and 2.5 times $w_1$.

The radii of the circular curvatures at 14*c* and 15*c* are typically between 0.150 and 0.160 inches for #1 through #7 irons; between 0.210 and 0.230 for #8 and #9 irons; and between 0.300 and 0.320 for a pitching wedge; however, these dimensions can vary.

Figure 3:
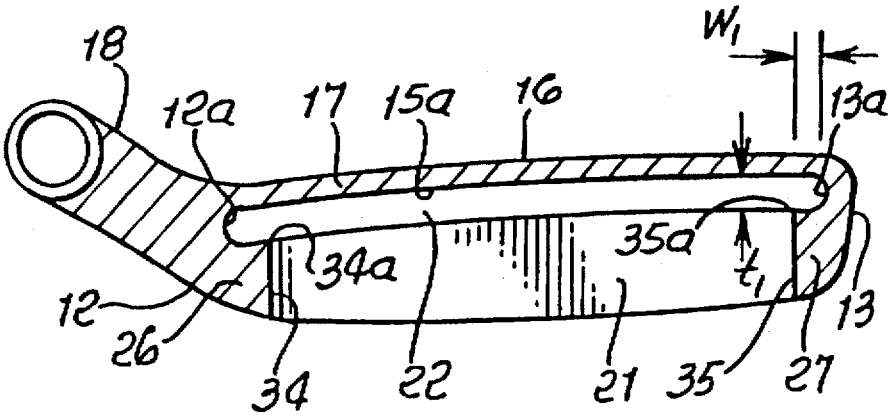
FIG. 3 is a section on lines 3—3 of FIG. 1.
Figure 4:
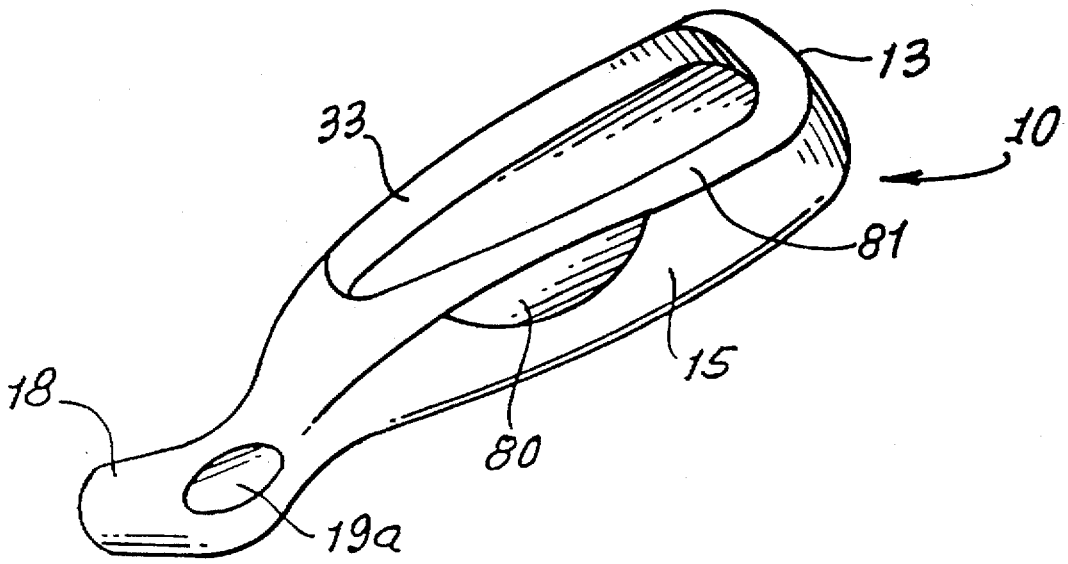
FIG. 4 is a rear perspective view of the FIG. 1 head.
Figure 5:
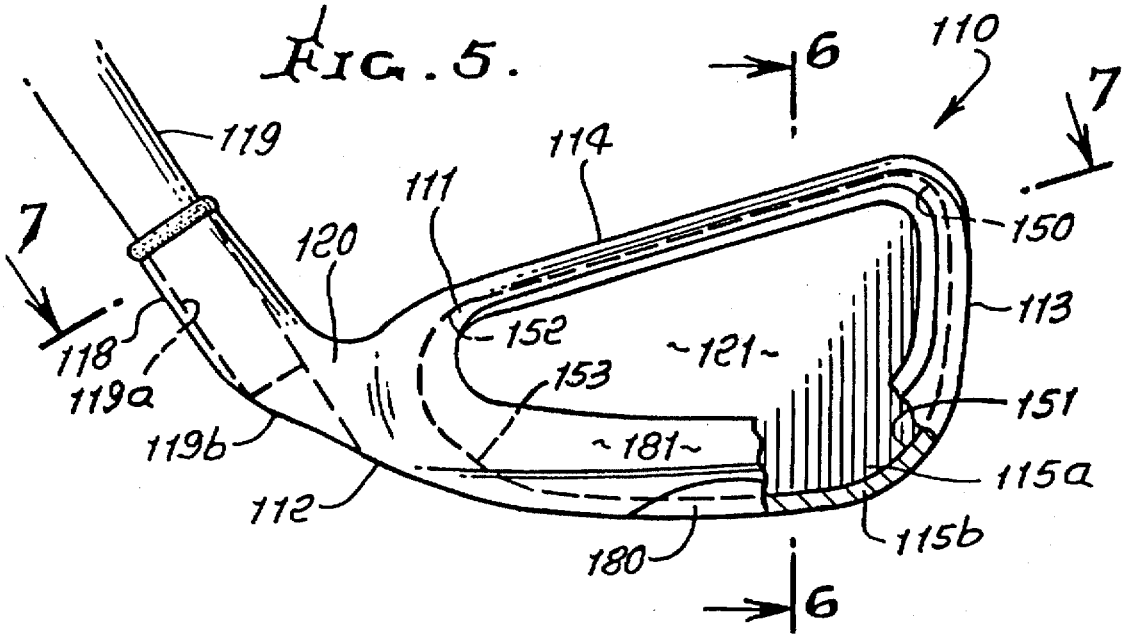
FIG. 5 is a view like FIG. 1 but showing a #6 iron incorporating the invention.

Note in this regard the rearward projections 26 and 27 in FIG. 3, extending rearwardly from the undercuts 12*a* and 13*a*, and also rearward projections at 24 and 25. Such rearward projections 24 and 25, 26 and 27 are elongated directly rearwardly of the undercuts 12*a*, 13*a*, 14*a*, and 15*a*, and in relation to their thickness dimensions, showing that metal has been redistributed to those projections to enhance the effects described and without increasing the overall vertical dimension of the head.

The inner sides or ledges 32 and 33, defined by the projections 24 and 25, are substantially flat in a forward-torearward direction; however, they define a loop in combination with the corresponding inner and curved sides 34 and 35 of the projections 26 and 27, that loop subtending the major aerial extent of the front face, including an enlarged "sweet spot". Correspondingly, all undercut recess portions 12*a*, 13*a*, 14*a*, and 15*a*, also defines, preferably, a loop. Undercut recess concave corners appear at 50, 51, 52, and 53. Dimension $D_3$, between 32 and 33, is substantially less than $D_1$ at all sections parallel to the section of FIG. 2. The undercut recess has a periphery defining an area $A_1$ within that periphery, the front face 16 having a maximum area, where:

$$0.90<A_1/A_2<0.95$$

It is found that the undercut recess structure substantially enlarges the effective sweet spot at the face 16. Side 32 is inclined upwardly and rearwardly from horizontal at between 1° and 3°; and side 33 is inclined downwardly and rearwardly from horizontal at between 1° and 3°. Bottom wall 15 is inclined at upwardly and rearwardly from horizontal at between 5° and 8°. A local relief facet 80 (inclined upwardly and rearwardly) is provided beneath the sweet spot location to intersect bottom wall 15 and rear surface 81.

Figure 17:
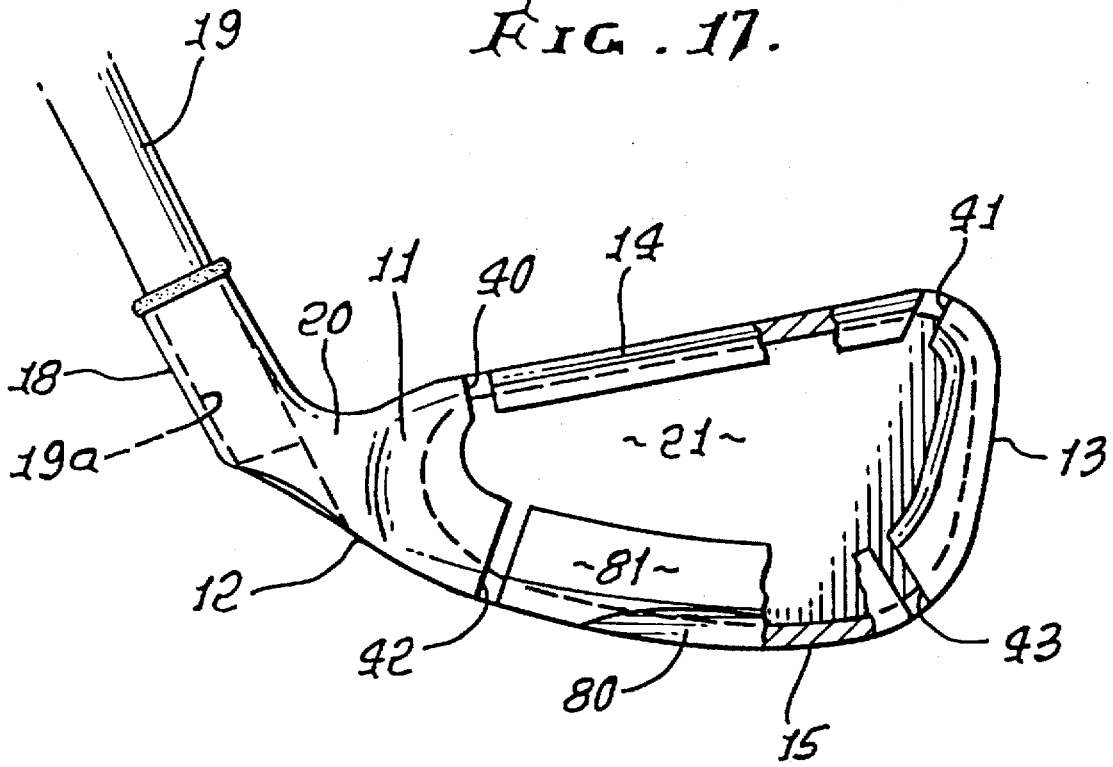
FIG. 17 is a view like FIG. 1 showing corner slots.

FIG. 17 shows that slots may be provided, as at 40–43, proximate corners of the loop defined by the rearward projections 24–27 to decouple or reduce the stiffening effect of joining the rearward extending portions 24–27 at the loop corners. This allows the momentum transfer from each of such portions to independently proceed forwardly, with delayed action, as referred to, without being affected by the momentum transfer associated with the other portions, or attenuated by the effects of such other portions.

FIGS. 5–8 show a corresponding construction of a #6 iron, having a more inclined front face, as shown. The corresponding numbered elements are the same as those in FIGS. 1–4, with each number preceded by a 1, i.e., providing a one hundred series of numbers.

FIGS. 9–12 correspond to FIGS. 1–4, but show a #8 iron with the two intersecting recesses in associated structure, as defined above. The corresponding elements have a 2 preceding each number, whereby a two hundred series of elements are defined.

FIGS. 13–16 correspond to FIGS. 1–4, but show a pitching wedge with the two recesses in associated structure, as defined above. The corresponding elements have a 3 preceding each number, whereby a three hundred series of elements are defined.

Figure 6:
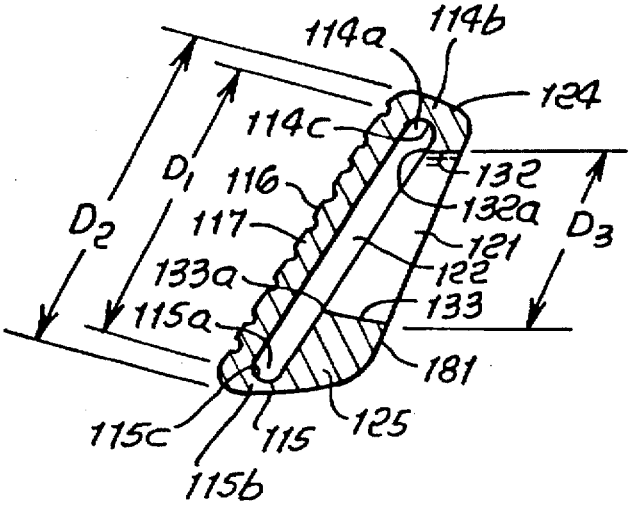
FIG. 6 is a vertical section taken on lines 6—6 of FIG. 5.
Figure 7:
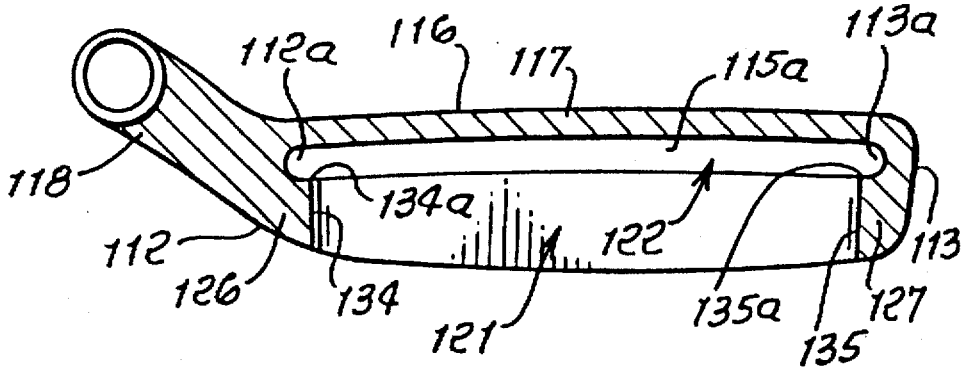
FIG. 7 is a section on lines 7—7 of FIG. 5.
Figure 8:
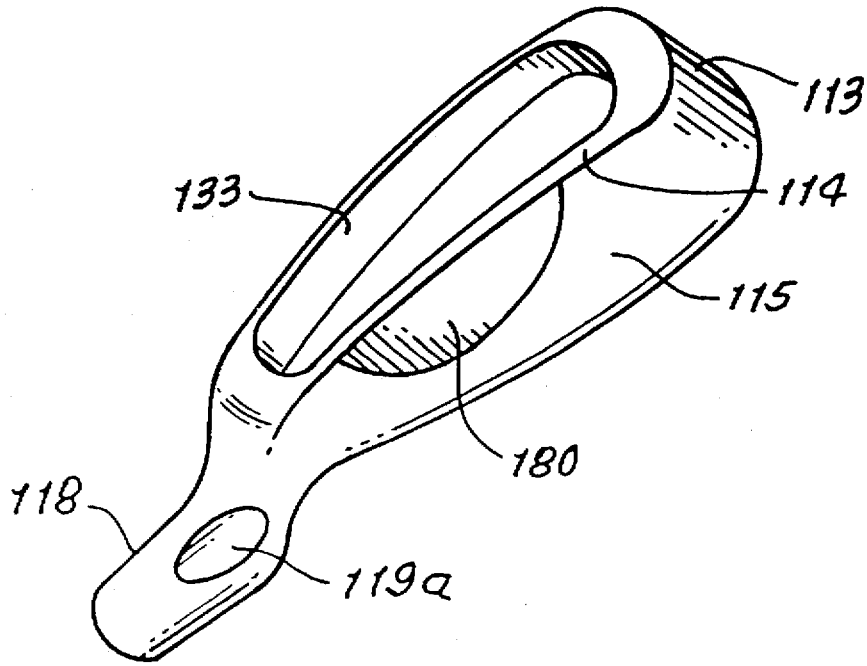
FIG. 8 is a rear perspective view of the FIG. 5 head.
Figure 9:
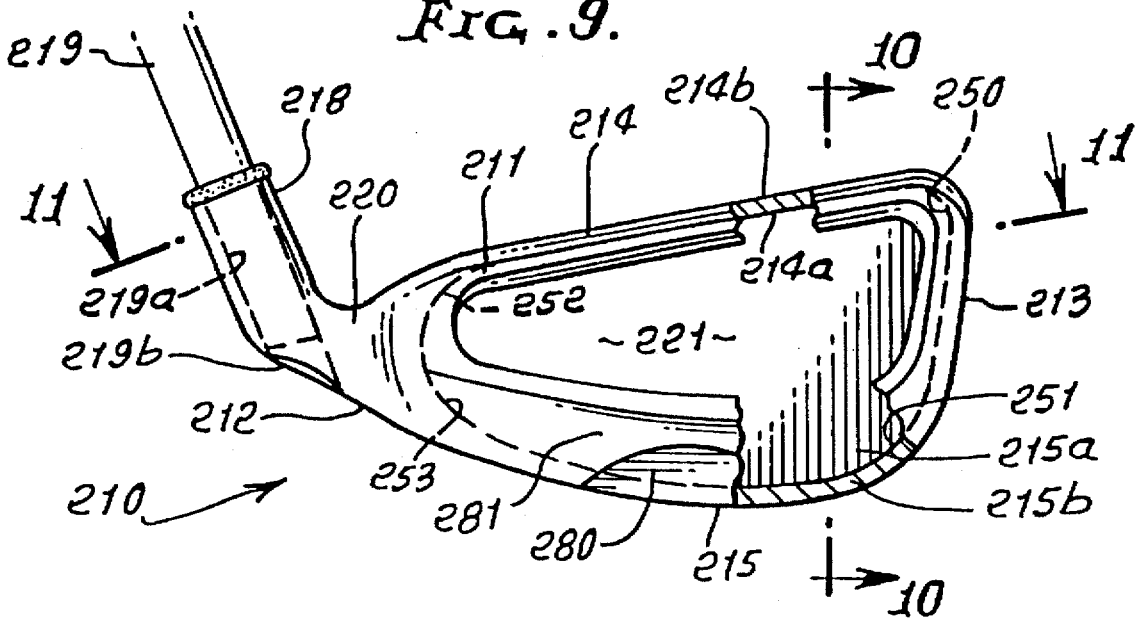
FIG. 9 is a view like FIG. 1 showing a #8 iron incorporating the invention.
Figure 10:
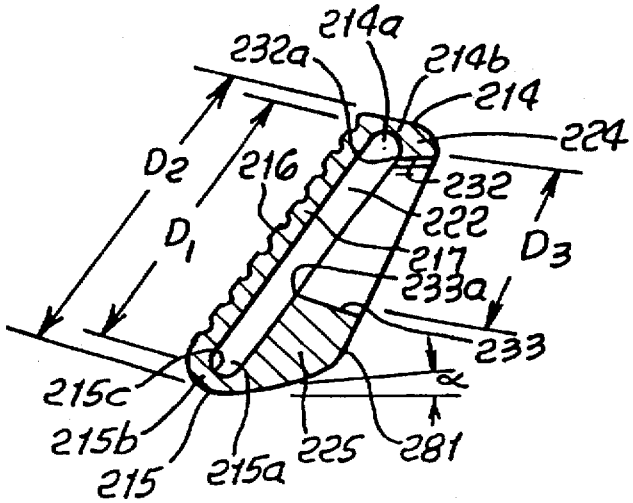
FIG. 10 is a vertical section taken on lines 10—10 of FIG. 9.
Figure 11:
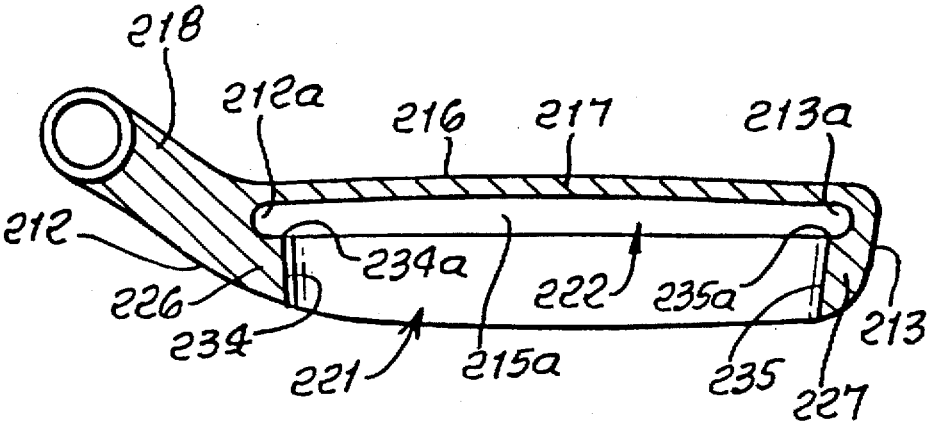
FIG. 11 is a section taken on lines 11—11 of FIG. 9.
Figure 12:
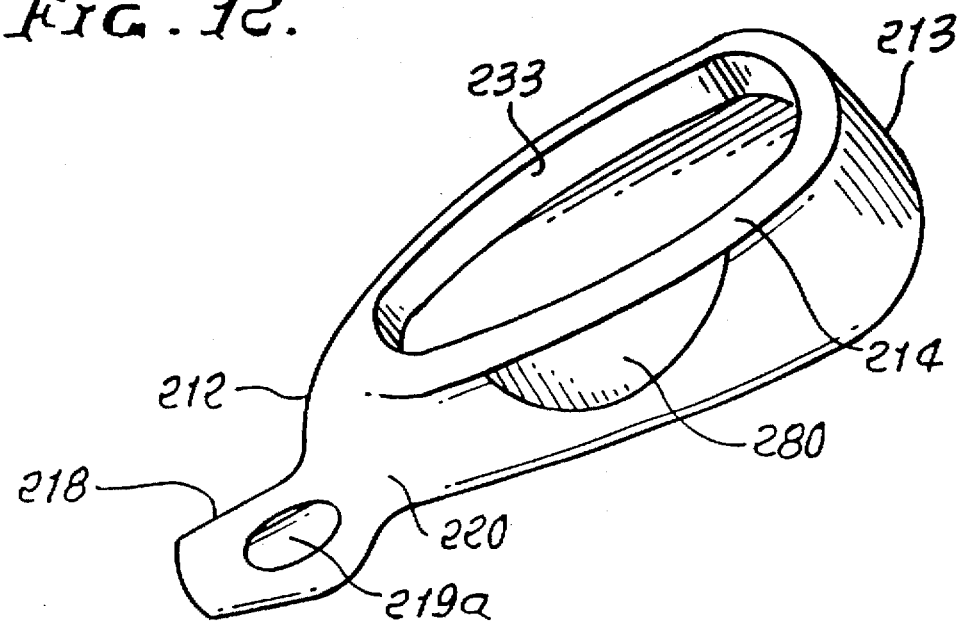
FIG. 12 is a rear perspective view of the FIG. 9 head.
Figure 13:
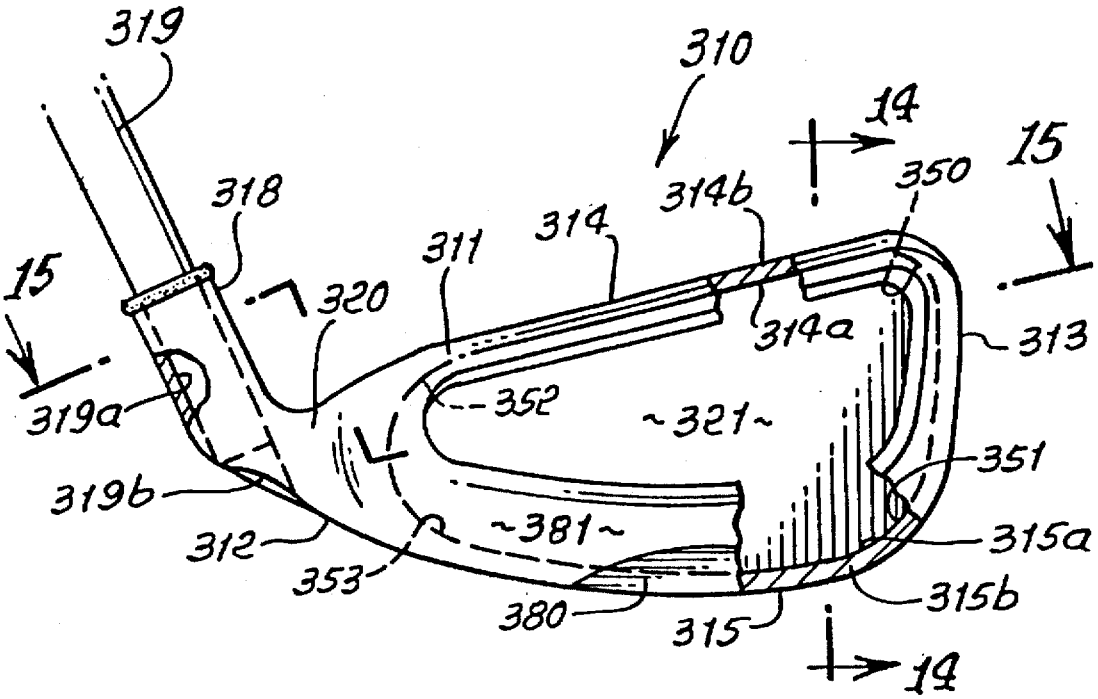
FIG. 13 is a view like FIG. 1 showing the rear side of a pitching wedge incorporating the invention.
Figure 14:
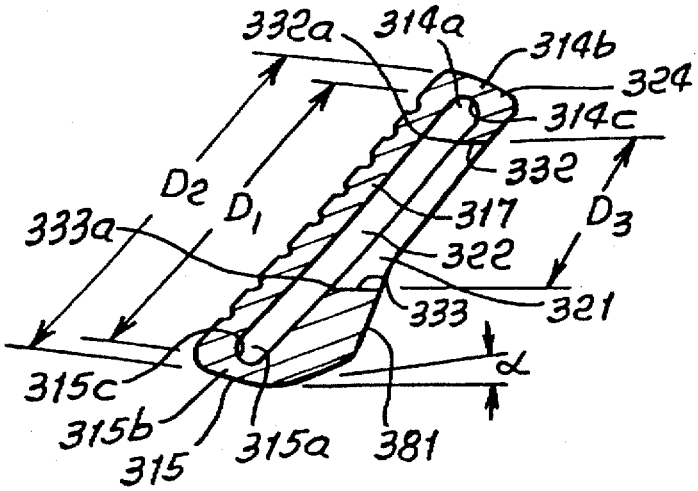
FIG. 14 is a vertical section taken on lines 14—14 of FIG. 13.
Figure 15:
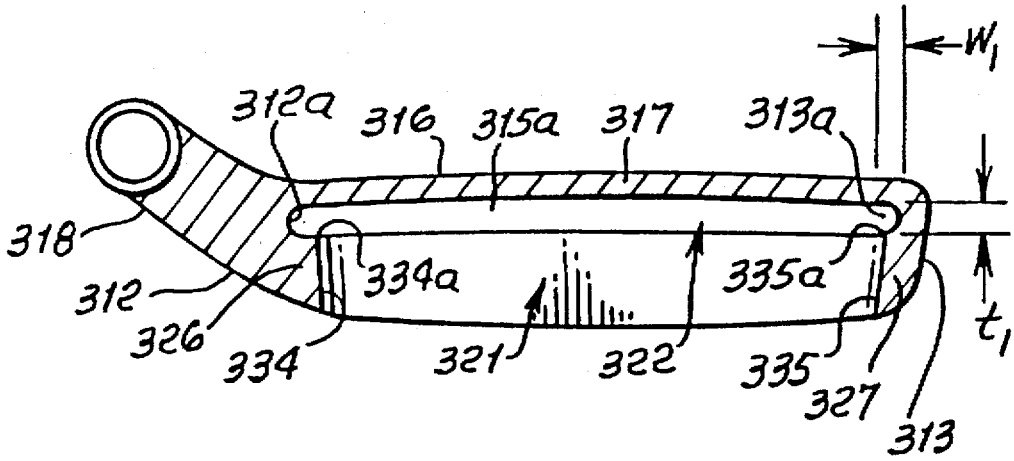
FIG. 15 is a section taken on lines 15—15 of FIG. 13.
Figure 16:
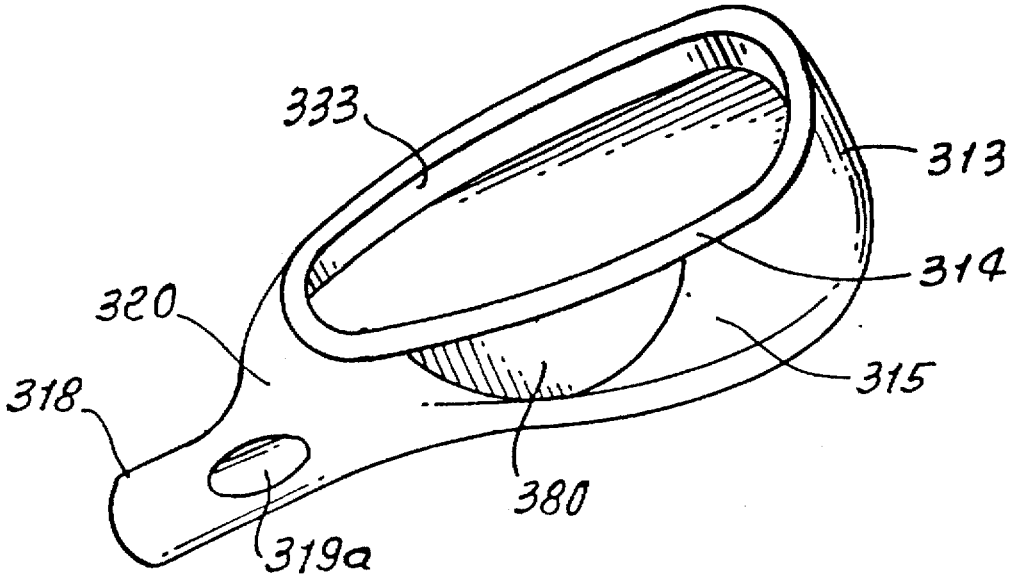
FIG. 16 is a rear perspective view of the FIG. 13 head.
Figure 18:
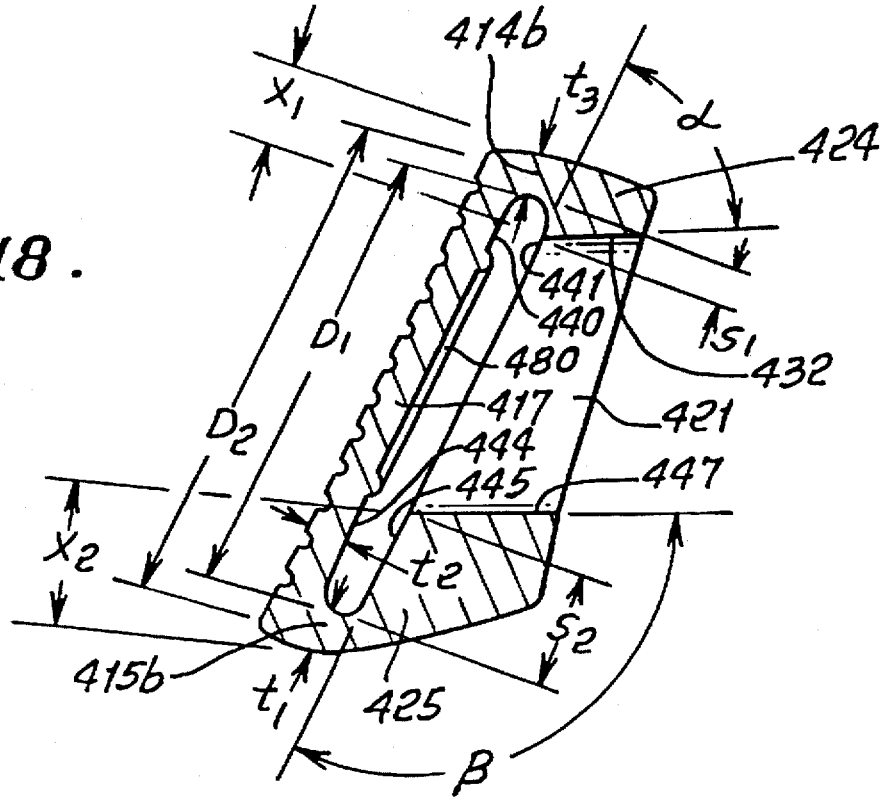
FIG. 18 is a view similar to FIG. 1 showing a #5 iron in cross section.

FIG. 18 corresponds to FIG. 6 but shows in representation actual size #5 iron in section, with elements corresponding to those of FIG. 6 numbered the same except for an initial "4" instead of "1".

In FIG. 18, upward overall thickening $X_2$ of the lower rearward projection 425 substantially exceeds the downward, overall thickening $X_1$ of the upper rearward projection 424; and typically $X_2$ is at least 1.25 $X_1$.

Further, the undercut recess extent toward the top wall of the head has forward and rearward sides 440 and 441 that extend generally parallel to one another; the upper rearward projection 424 has a lower surface 432 facing the main recess 421; and that lower surface 432 intersects the recess rearward side 441 at an acute angle α. In addition, the undercut recess extent toward the bottom wall of the head has forward and rearward sides 444 and 445 that extend generally parallel to one another; and the lower rearward projection 425 has an upper surface 447 facing the main recess 421; and that upper surface 447 intersects the recess rearward side 445 at an obtuse angle β.

FIG. 18 also shows that the upper undercut recess extent toward the top wall has slant height $S_1$ above the main recess; the undercut recess extent toward the bottom wall has slant height $S_2$ below the main recess; $S_2$ substantially exceeds $S_1$, and typically $S_2/S_1$ exceeds 1.5, as shown.

Further, the minimum thickness $t_1$ of lower web 415*b* is related to the thickness $t_2$ of the front wall 417 by the relation $t_1=t_2$; and the minimum thickness $t_3$ of the upper web 414*b* is related to $t_2$ by the relation $t_3=t_2$. As shown, and by virtue of such webs, the head has a C-shaped cross section in a plane (the plane of FIG. 18) normal to head length dimension between the toe and heel.

The above relationships are also found in FIGS. 2, 6, 10, and 14. Slant height $D_1$ and $D_2$ relationships found in FIG. 18 are the same as those in FIGS. 2, 6, 10, and 14. A medallion 480 is formed integrally with the rear side of the front wall 417.

It will be understood that intermediate irons have the same construction, but with associated changing front face inclinations, as in a set of such irons. Accordingly, each iron of the set has the invention incorporated therein.

Figure 19:
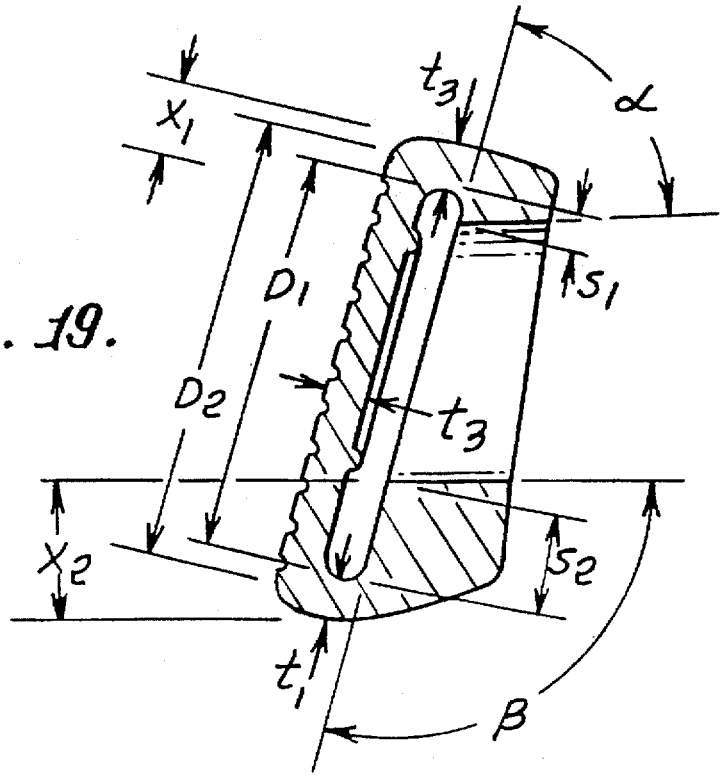
FIGS. 19 and 20 are views similar to FIG. 18 showing #1 and #9 irons in cross section.
Figure 20:
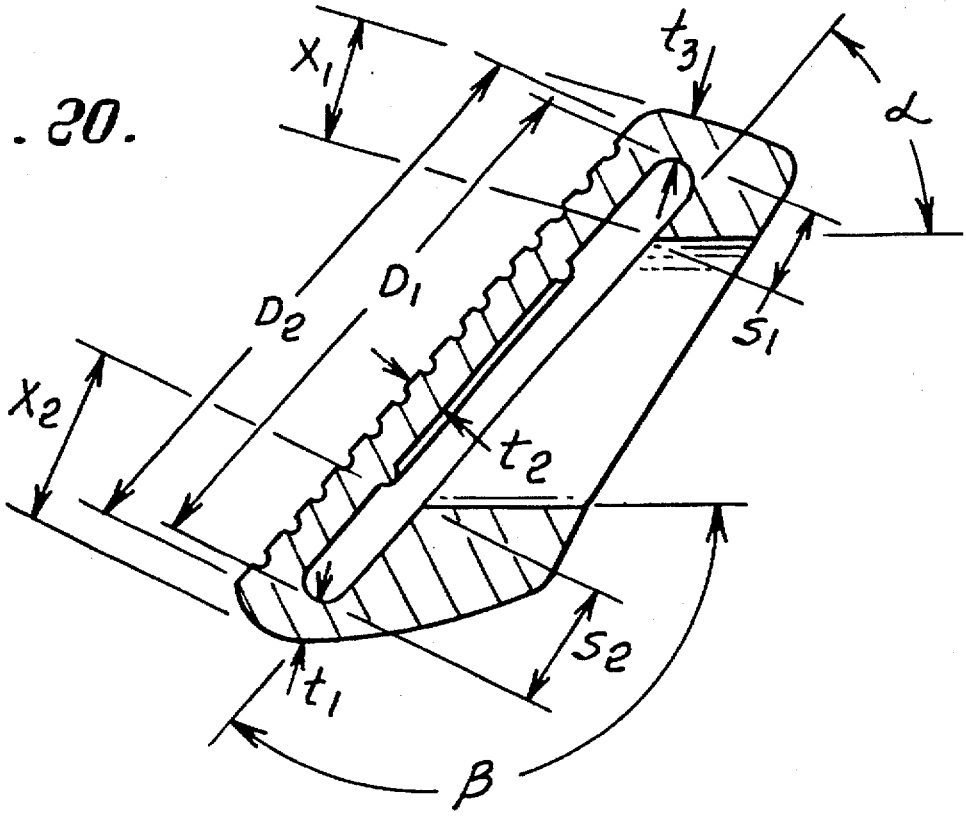

FIGS. 19 and 20 are views like FIG. 18 but showing #1 and #9 irons having related dimensional features, as described in connection with the above figures, especially FIG. 18. The relationships detailed in FIG. 18 remain generally the same for FIGS. 19 and 20.

Figure 21:
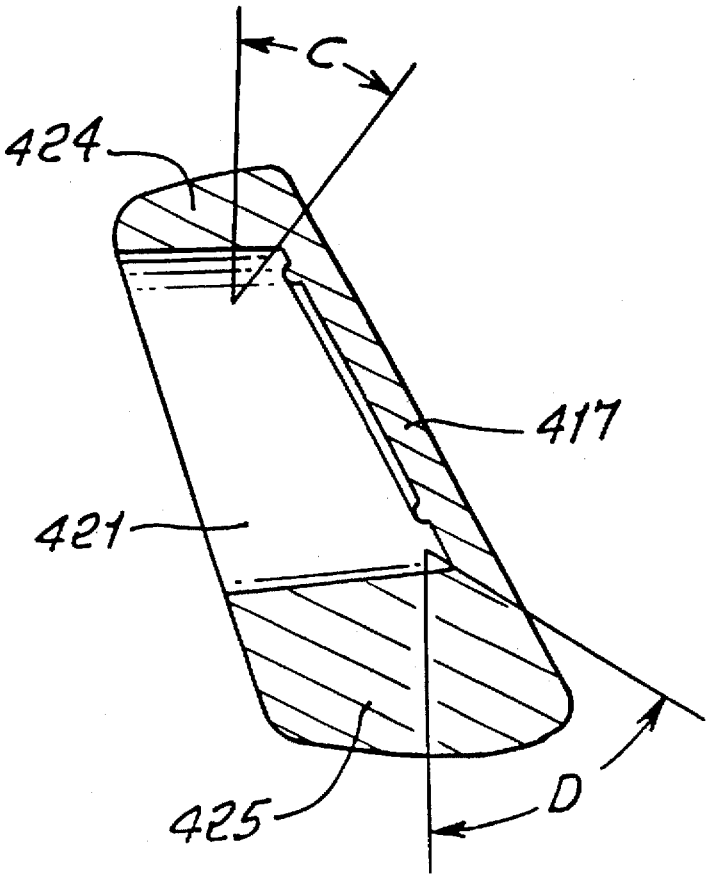
FIG. 21 is a view like FIG. 18 but showing regions of upper and lower web locations.

FIG. 21 is a view generally like FIG. 18 but indicates, at upper and lower zones C and D, where momentum or moment of inertia transfer occurs via reduced thickness webs created at those zones, i.e., at different locations in the latter, by auxiliary recesses found in the head. For simplicity, such recesses and webs are omitted. Zones C and D are characterized as located at the junctures of the front wall 417 of the head, with the upper and lower rearward projections 424 and 425, respectively. Main recess 421 extends forwardly toward wall 416.

FIGS. 22(*a*)–22(*e*) are fragmentary views showing different forms of such webs in upper zones C, as in FIG. 21. Upper web 414*b* in FIG. 22(*a*) is the same as, or similar to, web 314*b* in FIG. 14, i.e., is formed between undercut recess 414*a* and the upper surface 414' of upper wall 414, as in FIG. 14.

In FIG. 22(*b*), upper web 514*b* is formed between main recess 421 and auxiliary recess 514*a* cut downwardly (i.e., overcut) into the upper wall 414 from upper surface 414', intersected by 514*a*. Upper web 514*b* extends lengthwise of the head.

FIG. 22(*c*) is like FIG. 22(*b*) except that modified recess 514*a'* is cut downwardly at a slant into top wall 414 from a point proximate the uppermost extent of front face 416 of front wall 17, whereby web 514*b'* is formed.

Figure 22A:
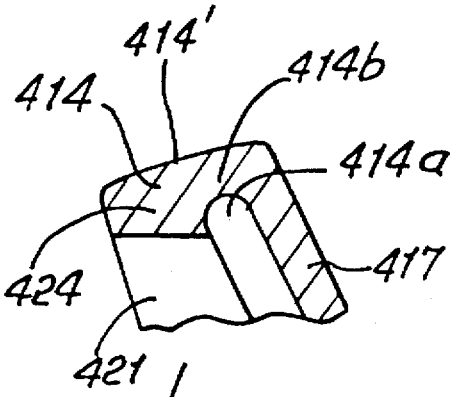
FIGS. 22(*a*)–22(*e*) and FIGS. 23(*a*)–23(*d*) are fragmentary sections showing various web locations and configurations.
Figure 22B:
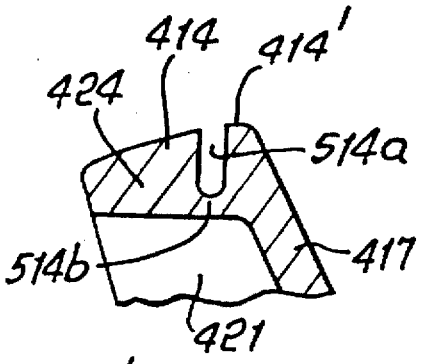
Figure 22C:
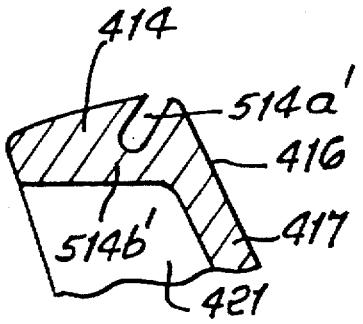
Figure 22D:
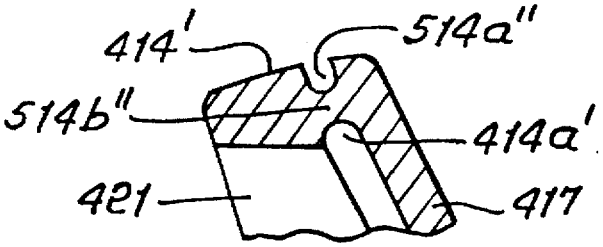
Figure 22E:
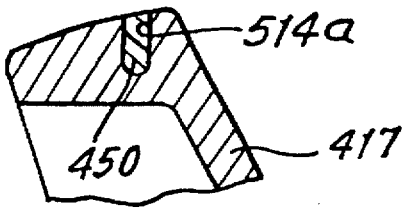
Figure 23A:
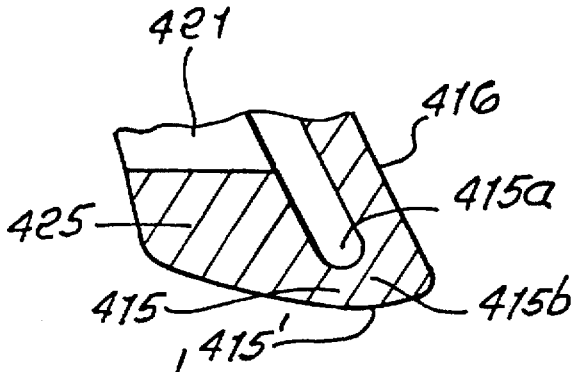
Figure 23B:
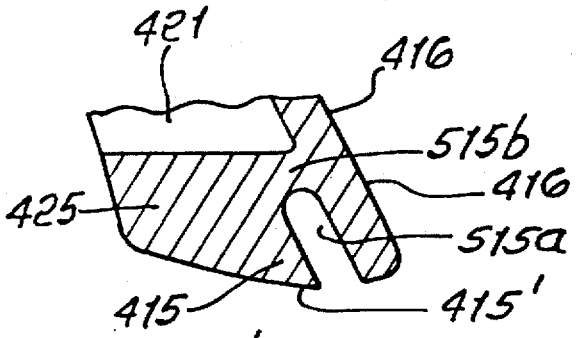
Figure 23C:
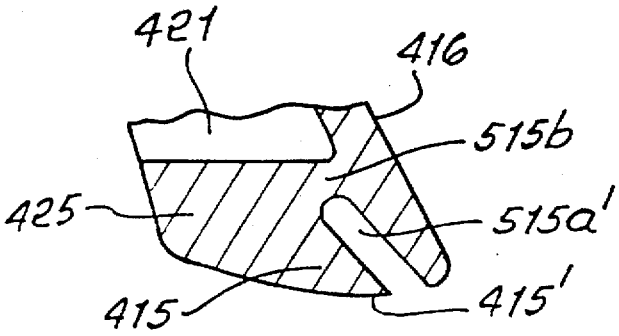
Figure 23D:
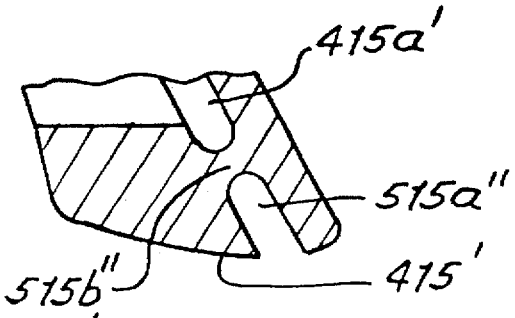

FIG. 22(*d*) is like FIG. 22(*a*) in that it incorporates an undercut recess 414*a'*, like 414*a*, except that recess 414*a'* is shallower in depth; also, FIG. 22*d* is like FIG. 22(*b*) in that it incorporates an auxiliary recess 514*a"* that intersects the top surface 414' of the head, recess 514*a"* being shallower in depth than recess 514*a*. A narrow web 514*b"* is formed between recesses 514*a"* and 414*a'*. Each such recess and web in FIGS. 22(*a*)–22(*d*) extends lengthwise along a path extending generally between the head, toe and heel. The heads are metallic.

In FIG. 22(*e*), the construction is the same as in FIG. 22(*b*) except that filler material 450 extends in and along recess 514*a*. That material may be non-metallic, and may bond to the recess walls. An example is a resinous material, such as epoxide, urethane or silicone rubber.

FIGS. 23(*a*)–23(*d*) are fragmentary views showing different forms of webs created in lower zones D, as referred to in FIG. 21. Lower web 415*b* in FIG. 23(*a*) is the same as, or similar to, web 314*b* in FIG. 14, i.e., is formed between undercut recess 415*a* and the lower surface 415' of lower wall 415, as in FIG. 14.

In FIG. 23(*b*), lower auxiliary web 515*b* is formed between main recess 421 and auxiliary recess 515*a*, cut upwardly into the lower wall 415 from its lower (i.e., outer) surface 415'. Recess 515*a* is located rearwardly of front face 416 and forwardly of main extent of lower projection and is parallel to the plane of 416.

FIG. 23(*c*) is like FIG. 23(*b*) except that modified recess 515*a'* is cut downwardly and forwardly at a slant relative to wall 416, to intersect bottom wall 415' at a point proximate the lowermost extent of front face 416, whereby web 515*b* is formed, as shown.

FIG. 22(*d*) is like FIG. 23(*a*) in that it incorporates an undercut recess 515*a'* like 515*a*, but shallower in depth than the latter; also, FIG. 23(*d*) is like FIG. 23(*b*) in that it incorporates an auxiliary (overcut) recess 515*a"* that intersects lower surface 415' of the head, recess 515*a"* being shallower in depth than recess 515*a*. A narrow web 515*b"* is formed between recesses 515*a'* and 515*a"*. Each such recess and web in FIGS. 23(*a*)–23(*d*) extends lengthwise along a path extending generally between the head, toe and heel regions. The heads are metallic.

Any one of the upper web configurations of FIGS. 22(*a*)–22(*d*) can be employed with any one of the lower web configurations of FIGS. 23(*a*)–23(*d*); however, FIGS. 22(*a*) would normally be used with 23(*a*); FIG. 22(*b*) with 23(*b*); FIG. 22(*c*) with FIG. 23(*c*); and FIG. 22(*d*) with FIG. 23(*d*). Any of the recesses can be filled, as in FIG. 22(*e*). The toe region of the head can also incorporate webs of the configurations described in FIGS. 22(*a*)–22(*d*) and 23(*a*)–23(*d*).

We claim:

1. A golf club head having a body defining a heel, toe, top wall, bottom wall, and a front wall defining an upwardly and rearwardly inclined front face and rear face, and also defining corner walls between said top wall and said heel and toe, and between said bottom wall and said heel and toe, and comprising a) said body defining a forwardly extending main recess located rearwardly of said front wall, b) said body also defining an undercut recess located directly rearwardly of said front wall to intersect said main recess and extending outwardly from said main recess toward at least one of said top wall and bottom walls, and also toward at least one of said corner walls, proximate said rear face, c) the thickness of said one wall measured in a plane generally parallel to said front wall front face and proximate said rear face being less than the thickness of said one wall measured in a plane generally parallel to said front face and distal said rear face.

2. The head of claim 1 wherein said rearward projection has downward thickening between said top wall and said main recess, and rearwardly of said undercut recess that extends toward said top wall, said undercut recess having forward and rearward sides, said rearward projection having a lower surface facing said main recess, said lower surface intersecting said rearward side of the undercut recess at an acute angle.

3. The head of claim 2 wherein said head also has rearward projection with upward thickening between said bottom wall and said main recess, and rearwardly of said undercut recess that extends toward said bottom wall, said undercut recess that extends toward said bottom wall having forward and rearward sides, said last named rearward projection having an upper surface facing said main recess, said upper surface intersecting said rearward side of the undercut recess extending toward said bottom wall at an obtuse angle.

4. A golf club head having a body defining a heel, toe, top wall, bottom wall, and a front wall defining an upwardly and rearwardly inclined front face and rear face, and comprising a) said body defining a forwardly extending main recess located rearwardly of said front wall, b) said body also defining an undercut recess located rearwardly of said front wall rear face and extending outwardly from said main recess and toward said top wall, proximate said rear face, c) the thickness of said top wall measured in a plane generally parallel to said front wall front face and proximate said rear face being less than the thickness of said top wall measured in a plane generally parallel to said front face and distal said rear face.

5. A golf club head having a body defining a heel, toe, top wall, bottom wall, and a front wall defining an upwardly and rearwardly inclined front face and rear face, and comprising a) said body defining a forwardly extending main recess located rearwardly of said front wall, b) said body also defining an undercut recess located rearwardly of said front wall rear face and extending outwardly from said main recess toward said top wall and toward said bottom wall, proximate said rear face, c) said head having rearward projection with upward thickening between said bottom wall and said main recess, and rearwardly of said undercut recess that extends toward said bottom wall, d) said head also having rearward projection with downward thickening between said top wall and said main recess, and rearwardly of said undercut recess that extends toward said top wall, e) each of said rearward projections tapering rearwardly, f) the thickness of said top wall measured in a plane generally parallel to said front wall front face and proximate said rear face being less than the thickness of said top wall measured in a plane generally parallel to said front face and distal said rear face.

6. A golf club head as defined in claim 5 wherein said rear face has a slant height dimension $D_1$ between uppermost and lowermost extents of said undercut recess in a vertical plane generally normal to lengthwise horizontal extent of the head between the heel and toe, and said front wall has a slant height dimension $D_2$ between uppermost and lowermost extents thereof in said plane, and wherein $D_1/D_2$ exceeds about 0.90.

7. A golf club head having a body defining a heel, toe, top wall, bottom wall, and a front wall defining an upwardly and rearwardly inclined front face and rear face, and comprising a) said body defining a forwardly extending main recess located rearwardly of said front wall, b) said body also defining an undercut recess located rearwardly of said front wall rear face and extending outwardly from said main recess toward said top wall and toward said bottom wall, proximate said rear face, c) said head having first rearward projection with upward thickening between said bottom wall and said main recess, said rearward projection tapering rearwardly of said undercut recess that extends toward said bottom wall, d) said head also having second rearward projection with downward thickening between said top wall and said main recess, said second rearward projection tapering rearwardly of said undercut recess that extends toward said top wall, e) said undercut recess extending toward said top wall having slant height $S_1$ above said main recess, said undercut recess extending toward said bottom wall having slant height $S_2$ below said main recess, and wherein $S_2$ substantially exceeds $S_1$.

8. The head of claim 7 wherein $S_2/S_1>1.5$.

9. The head of claim 7 wherein the head is locally downwardly concave toward said undercut recess that extends toward said top wall, and is upwardly concave toward said undercut recess that extends toward said bottom wall.

10. The head of claim 7 wherein said head defines a first web that is upwardly concave toward said undercut recess that extends toward said bottom wall, and a second web that is downwardly concave toward said undercut recess that extends toward said top wall.

11. The head of claim 10 wherein the head has C-shaped cross-section in a plane normal to length dimension of the head between said toe and said heel.

12. The head of claim 10 wherein said second web has minimum thickness $t_1$ between the top wall and the undercut recess, and the front wall has thickness $t_2$, and wherein $t_1 \approx t_2$.

13. The head of claim 10 wherein said first web has minimum thickness $t_3$ between the bottom wall and the undercut recess, and the front wall has thickness $t_2$, and wherein $t_3 \approx t_2$.

14. The head of claim 12 wherein the first web has minimum thickness $t_3$ between the bottom wall and the undercut recess, and wherein $t_3 \approx t_2$.

15. The head of claim 1 including a medallion on said rear wall and facing rearwardly toward said main recess.

16. The head of claim 4 including a medallion on said rear wall and facing rearwardly toward said main recess.

17. The head of claim 5 including a medallion on said rear wall and facing rearwardly toward said main recess.

18. The head of claim 7 including a medallion on said rear wall and facing rearwardly toward said main recess.

19. A golf club head having a body defining a heel, toe, top wall, sole, and a front wall defining an upwardly and rearwardly inclined front face in ball-addressing position of the head, and a rear face, and comprising a) said body defining a forwardly extending main recess located rearwardly of said front wall, b) and said body having at least one projection extending rearwardly from said front wall and outwardly of said main recess, said projection being rearwardly elongated, c) said body defining a first auxiliary recess located rearwardly of said front face and forwardly of the main extent of said projection, said auxiliary recess extending into proximity with outer surface extent of the head, d) the thickness of said projection measured in a plane generally parallel to said front wall front face and proximate said rear face being less than the thickness of said projection measured in a plane generally parallel to said front face and distal said rear face.

20. The head of claim 19 wherein said first auxiliary recess intersects the surface of the head along a path extending generally between the heel and toe and above the main recess.

21. The head of claim 19 wherein said first auxiliary recess intersects the surface of the head along a path extending generally between the heel and toe and below the main recess.

22. The head of claim 19 wherein there is a web formed adjacent the first auxiliary recess and spaced from said main recess.

23. The head of claim 20 wherein there is a web formed between innermost extent of the first auxiliary recess and said main recess.

24. The head of claim 21 wherein there is a web formed between innermost extent of the first auxiliary recess and said main recess.

25. The head of claim 20 wherein there is a second auxiliary recess located rearwardly of said front face and intersecting the surface of the head along a path extending generally between the heel and toe and below the main recess.

26. The head of claim 25 wherein there is a first web formed adjacent the first auxiliary recess and spaced from said main recess, and there is a second web formed adjacent second auxiliary recess and spaced from said main recess.

27. The head of claim 19 wherein said body also defines an undercut recess located rearwardly of said front wall rear face, and extending outwardly from said main recess generally toward outer surface extent of the head.

28. The head of claim 27 wherein said undercut recess is spaced from said first auxiliary recess.

29. The head of claim 28 including a web formed by said body between said first auxiliary recess and said undercut recess.

30. The head of claim 19 including non-metallic filler material in said first auxiliary recess.

31. The head of claim 24 including non-metallic filler material in said first and second auxiliary recesses.

32. The golf club head of claim 19 wherein said body has a third rearward projection at said toe and which is rearwardly elongated adjacent said main recess.

33. The head of claim 32 wherein said body defines an additional auxiliary recess located rearwardly of said front face and forwardly of main extent of said third projection.

34. The golf club head of claim 32 wherein said third recess intersects outer surface extent of the head.

35. The head of claim 34 including non-metallic filler in said third recess.

36. The golf club head of claim 19 wherein there is another of said projections and both projections taper rearwardly.

37. The golf club head of claim 19 wherein said projections are upper and lower projections, and they taper rearwardly.

38. The golf club head of claim 33 wherein each of said projections tapers rearwardly.

39. The golf club head of claim 19 wherein said body is metallic.

40. The golf club head of claim 19 wherein each of said rearward projections has an overall rearward length dimension and a thickness dimension outwardly from said main recess, said length dimension substantially exceeding said thickness dimension.

41. The golf club head having a body defining a heel, toe, top wall, sole, and a front wall defining an upwardly and rearwardly inclined front face and rear face, and comprising a) said body defining a forwardly extending main recess located rearwardly of said front wall, b) and said body also defining an undercut recess located directly rearwardly of said front wall rear face and extending outwardly from said main recess toward at least one of said top wall and said bottom wall, adjacent said rear face, said rear face having a slant height dimension $D_1$ between uppermost and lowermost extents of said rear face in a vertical plane normal to said front wall, and said front wall having a slant height dimension $D_2$ between uppermost and lowermost extents thereof in said plane, where: $D_1$ is between about 0.90 and 0.95 $D_2$.

42. The golf club head of claim 41 wherein said undercut recess also extends outwardly from said main recess and adjacent said front wall rear face and toward said toe.

43. The club head of claim 42 wherein said undercut recess extends outwardly from said main recess and adjacent said front wall rear face and toward said heel, said rear face having a periphery defining an area $A_1$ within said periphery, and said front face having a maximum area $A_2$, where $$0.90<A_1/A_2<0.95.$$

44. The golf club head of claim 41 wherein said at least one of said top wall and bottom wall has substantially reduced thickness outwardly of said undercut recess.

45. The golf club head of claim 44 wherein said undercut recess extends generally parallel to the inclined front face.

46. The golf club head of claim 41 wherein said head has rearward projection with upward thickening between said bottom wall and said main recess, and rearwardly of said undercut recess that extends toward said bottom wall, said undercut recess that extends toward said bottom wall having forward and rearward sides that extend parallel to one another.

47. The golf club head of claim 41 wherein said head has rearward projection with downward thickening between said top wall and said main recess, and rearwardly of said undercut recess that extends toward said top wall, said undercut recess that extends toward said top wall having forward and rearward sides that extend parallel to one another.

48. The golf club head of claim 46 wherein said head has rearward projection with downward thickening between said top wall and said main recess, and rearwardly of said undercut recess that extends toward said top wall, said undercut recess that extends toward said top wall having forward and rearward sides that extend parallel to one another.

49. The golf club head of claim 41 wherein said body is metallic.

50. The golf club of claim 41 wherein said body consists of a metallic casting.

51. The golf club head of claim 49 wherein said body is a one-piece casting, and defines an iron golf club head.

52. The golf club head of claim 41 wherein said undercut recess projects outwardly to an extent $w_1$, and has front to rear thickness $t_1$, where $$0.5t_1<w_1<1.5t_1.$$

53. The golf club head of claim 46 wherein said rearward projection from the undercut recess has substantially greater overall rearward dimension than vertical thickness dimension.

54. The golf club head of claim 47 wherein said rearward projection from the undercut recess has substantially greater overall rearward dimension than vertical thickness dimension.

55. The golf club head of claim 41 wherein said body has at least one slit extending rearwardly from said undercut recess and extending outwardly from said main recess.

56. The golf club head of claim 41 wherein said body has four slits extending rearwardly from said undercut recess and extending outwardly from said main recess at the following locations:

proximate the junction of the heel and top wall proximate the junction of the heel and bottom wall proximate the junction of the toe and top wall proximate the junction of the toe and bottom wall.

57. The golf club head of claim 44 wherein said undercut recess extends upwardly toward said top wall and downwardly toward said bottom wall.

58. The golf club head of claim 57 wherein said undercut recess has a substantially semi-circular cross section adjacent said one of said top and said bottom walls.

59. The golf club head of claim 41 wherein said undercut recess proximate said heel and proximate the toe decreases gradually in depth toward said heel and toward said toe.

60. A golf club head having a body defining a heel, toe, top wall, sole and a front wall defining an upwardly and rearwardly inclined front face and rear face, and comprising a) said body defining a forwardly extending main recess located rearwardly of said rear face, b) and said body also defining an undercut recess located directly rearwardly of said rear face and extending outwardly from said main recess toward at least one of the following:
i) said top wall
ii) said bottom wall, c) said rear face having uppermost and lowermost extents defining a separation distance $D_1$, the front face having uppermost and lowermost extents defining a separation distance $D_2$, where $$0.90<D_1/D_2<0.95$$

d) said undercut recess openly exposed to said main recess, and said rear face outwardly of said main recess.

61. The golf club head of claim 60 wherein said one of said top and bottom walls has minimum thickness proximate said undercut recess.

62. The golf club head of claim 61 wherein said minimum thickness is between 0.075 and 0.085 inches.

63. Multiple golf club heads in a set, each head having a body defining a heel, toe, top wall, sole and a front wall defining an upwardly and rearwardly inclined front face, and comprising a) said body defining a forwardly extending main recess located rearwardly of said front wall, b) and said body also defining an undercut recess located directly rearwardly of said front wall and extending outwardly from said main recess toward at least three of the following:
i) said top wall
ii) said bottom wall
iii) said toe
iv) said heel
v) a corner between said top wall and toe
vi) a corner between said top wall and heel
vii) a corner between said bottom wall and toe
viii) a corner between said bottom wall and heel, c) the undercut recesses in said bodies of the set having increasing rearward angularity in correspondence to increasing rearward angularity of the inclined front faces of the bodies of the set, d) the undercut recesses in each body of the set having generally parallel forward and rearward walls, e) said front wall having front and rear faces, said rear face having a slant height dimension $D_1$ between uppermost and lowermost extents thereof, and said front face having a slant height dimension $D_2$ between uppermost and lowermost extents thereof in said plane, where: $D_1/D_2$ is between about 0.90 and about 0.95, f) said undercut recess openly exposed to said main recess.

64. The invention of claim 63 wherein in each of said bodies, the undercut recess projects toward the top wall and toward the bottomwall as defined, the undercut recess projecting toward the top wall having depth less than the undercut recess, projecting toward the bottom wall.

65. The golf club head of claim 63 including slots formed in corners defined by said head and intersecting said undercut recess.

66. The golf club head of claim 65 wherein there are four of said slots, two of which are proximate the head toe, and two of which are proximate a juncture defined by the head and a hosel integral therewith.

67. A golf club head having a body defining a heel, toe, top wall, bottom wall, a sole, and a front wall defining an upwardly and rearwardly inclined front face, and comprising a) said body defining a forwardly extending main recess located rearwardly of said front wall, b) and said body also defining an undercut recess located directly rearwardly of said front wall and extending outwardly from said main recess toward at least said top wall and said bottom wall, c) said top wall tapering rearwardly and being rearwardly elongated rearwardly of said undercut recess to overlie said main recess, and said bottom wall tapering rearwardly and being rearwardly elongated rearwardly of said undercut recess to underlie said main recess, said top wall defining a reduced thickness web adjacent to and above said undercut recess, said web located rearwardly of the uppermost level of said front face, and said undercut recess nearest said web extending upwardly to a level proximate said uppermost level of said front face, g) said rear face having a slant height dimension $D_1$ between uppermost and lowermost extents of said undercut recess in a vertical plane, and said front wall having a slant height dimension $D_2$ between uppermost and lowermost extents thereof in said plane, where:

$$0.90<D_1/D_2<0.95.$$

h) said undercut recess openly exposed to said main recess.

68. The head of claim 41 wherein said main recess, proximate said undercut recess, has a slant height dimension $D_3$ in said vertical plane, where $$D_3<D_1<D_2.$$

69. The head of claim 67 wherein said main recess, proximate said undercut recess, has a slant height dimension $D_3$ in said vertical plane, where $$D_3<D_1<D_2$$

and wherein said rearward projection with upper thickening defines a top ledge, and said rearward projection with downward thickening defines a bottom ledge, said ledges having relative forward taper toward their intersection with said undercut recess.

70. A golf club head having a body defining a heel, toe, top wall, sole, and a front wall defining an upwardly and rearwardly inclined front face in ball-addressing position of the head, and comprising a) said body defining a forwardly extending main recess located rearwardly of said front wall, b) and said body having upper and lower projections extending rearwardly from said front wall above and below said main recess, c) said body defining a first auxiliary recess located rearwardly of said front face and forwardly of the main extent of one of said projections, d) said first auxiliary recess extending proximate outermost surface extent of the head along a path extending generally between the heel and toe, e) there being a web extending parallel to said path, and located adjacent said first auxiliary recess and in communication with said main recess.

71. A golf club head having a body defining a heel, toe, top wall, sole, and a front wall defining an upwardly and rearwardly inclined front face in ball-addressing position of the head, and comprising a) said body defining a forwardly extending main recess located rearwardly of said front wall, b) and said body having upper and lower portions extending rearwardly from said front wall above and below said main recess, c) said body defining a first auxiliary recess located rearwardly of said front face and forwardly of the main extent of one of said portions, d) said first auxiliary recess extending along a path extending generally between the heel and toe, e) there being a web extending parallel to said path, and located adjacent said first auxiliary recess and in communication with said main recess.

72. A golf club head having a body defining a heel, toe, top wall, bottom wall, a front wall defining an upwardly and rearwardly inclined front face, and comprising a) said body defining a forwardly extending main recess located rearwardly of said front wall, b) said body also defining an undercut recess located directly rearwardly of said front wall to intersect said main recess, and extending outwardly from said main recess toward and into one of said top and bottom walls, c) said one wall extending rearwardly of said undercut recess, said one wall having reduced vertical thickness outwardly of said undercut recess, in relation to its thickness rearwardly of said recess, thereby to define a web, d) said web located rearwardly of the nearest peripheral level of said front face, and said undercut recess nearest said web extending to a level proximate the nearest peripheral level of said front face.

73. A golf club head having a body defining a heel, toe, top wall, a bottom wall, and a front wall defining an upwardly and rearwardly inclined front face, said front wall having a rear side, and comprising a) said body defining a forwardly extending main recess located rearwardly of said front wall, b) said body also defining upper and lower body portions respectively located above and below said main recess and respectively associated with said top and bottom walls, c) there being an undercut recess extending in said body proximate said front wall rear side and to an outermost level proximate the nearest outermost level of said front face, said undercut recess intersecting said main recess.

74. The golf club head of claim 73 wherein said body defines a reduced thickness web located outwardly of said undercut recess, said web elongated in a direction generally between said heel and toe.

75. A golf club head comprising:

a) a unitary metallic body, including a top body portion, a bottom body portion, and a front wall interposed between said top body portion and said bottom body portion, b) said front wall having a front surface and a rear surface, c) said top body portion having an upper surface and a lower surface, d) said bottom body portion having an upper surface and a lower surface, e) said top body portion lower surface, said front wall rear surface, and said bottom body portion upper surface defining a recess, f) said top body portion extending rearward from said front wall over said recess, g) said top body portion lower surface having a lowermost extent spaced from said front wall rear surface, h) said top body portion lower surface having an uppermost extent intermediate said lowermost extent and said front wall rear surface, and i) said top body portion lower surface uppermost extent being proximate said top body portion upper surface, the thickness of said top body portion measured in a plane generally parallel to said front wall front surface and proximate said rear surface being less than the thickness of said top body portion measured in a plane generally parallel to said front surface and distal said rear surface.

76. The golf club head of claim 75 wherein said bottom body portion extends rearward from said front wall under said recess.

77. The golf club head of claim 75 wherein said top body portion lower surface lowermost extent is spaced from a rearwardmost extent of said top body portion lower surface.

78. The golf club head of claim 75 wherein the distance between said top body portion lower surface uppermost extent and said top body portion upper surface is approximately equal to the thickness of said front wall.

79. A golf club head comprising:

a) a unitary metallic body, including a top body portion, a bottom body portion, and a front wall interposed between said top body portion and said bottom body portion, b) said front wall having a front surface and a rear surface, c) said top body portion having an upper surface and a lower surface, d) said bottom body portion having an upper surface and a lower surface, e) said top body portion extending rearward from said front wall, f) said top body portion lower surface having a lowermost extent, said top body portion lower surface inclining upwardly to reach an uppermost extent of said top body portion lower surface, the thickness of said top body portion measured in a plane generally parallel to said front wall front surface and proximate said rear surface being less than the thickness of said t op body portion measured in a plane generally parallel to said front surface and distal said rear surface.

80. The golf club head of claim 79 wherein said bottom body portion extends rearward from said front wall.

81. The golf club head of claim 80 wherein said top body portion lower surface lowermost extent is spaced from a rearwardmost extent of said top body portion lower surface.

82. The golf club head of claim 80 wherein the distance between said top body portion lower surface uppermost extent and said top body portion upper surface is approximately equal to the thickness of said front wall.

83. A golf club head comprising:

a) a unitary metallic body including a top body portion, a bottom body portion, and a front wall interposed between said top body portion and said bottom body portion, b) said front wall having a front surface and a rear surface, c) said top body portion having an upper surface and a lower surface, d) said bottom body portion having an upper surface and a lower surface, e) there being recess structure below said top body portion lower surface, rearward of said front wall rear surface, and above said bottom body portion upper surface, f) said top body portion lower surface including a forward extent, and a rearward extent, said rearward extent spaced rearwardly from said front wall rear surface, said forward extent extending proximate said top body portion upper surface, g) said body defining an integral rib above said top body portion lower surface extent and below said top body portion upper surface, said rib extending rearwardly from and relative to uppermost extent of said front wall, and said rib extending generally in a heel-to-toe direction, wherein said integral rib of said top body portion forward extent is thinner than the thickness of said top body portion rearward extent as measured in a plane substantially parallel to said front wall front surface.

84. The golf club head of claim 83 wherein said rib has thickness that is approximately equal to the thickness of said front wall below said uppermost extent thereof.

85. The golf club head of claim 83 wherein said head has a heel and toe, and said rib is elongated in a direction generally between said heel and toe.

* * * * *